US011208179B2

(12) United States Patent
Yamazaki

(10) Patent No.: US 11,208,179 B2
(45) Date of Patent: Dec. 28, 2021

(54) MAINTENANCE FACILITY, POWER GENERATION FACILITY, AND MAINTENANCE METHOD FOR DEVICE

(71) Applicant: Mitsubishi Hitachi Power Systems, Ltd., Kanagawa (JP)

(72) Inventor: Shinichi Yamazaki, Kanagawa (JP)

(73) Assignee: MITSUBISHI POWER, LTD., Kanagawa (JP)

( * ) Notice: Subject to any disclaimer, the term of this patent is extended or adjusted under 35 U.S.C. 154(b) by 0 days.

(21) Appl. No.: 16/465,270

(22) PCT Filed: Mar. 22, 2018

(86) PCT No.: PCT/JP2018/011542

§ 371 (c)(1),
(2) Date: May 30, 2019

(87) PCT Pub. No.: WO2018/180935

PCT Pub. Date: Oct. 4, 2018

(65) Prior Publication Data

US 2019/0291829 A1 Sep. 26, 2019

(30) Foreign Application Priority Data

Mar. 31, 2017 (JP) ..... JP2017-072106

(51) Int. Cl.

*B63B 35/44* (2006.01)
*B63B 27/10* (2006.01)
*B63B 35/00* (2020.01)

(52) U.S. Cl.

CPC ..... *B63B 35/44* (2013.01); *B63B 27/10* (2013.01); *B63B 35/00* (2013.01); *B63B 2035/4433* (2013.01)

(58) Field of Classification Search

CPC ..... B63B 35/44; B63B 35/00; B63B 27/10; B63B 2035/4433

See application file for complete search history.

(56) References Cited

U.S. PATENT DOCUMENTS 4,281,615 A * 8/1981 Wilson ..... B63B 35/4413 114/265
5,558,037 A * 9/1996 Manning ..... B63B 35/44 114/264

(Continued)

FOREIGN PATENT DOCUMENTS

CN 103112553 5/2013
JP 54-80991 6/1979

(Continued)

OTHER PUBLICATIONS

Notification of Reason for Refusal dated Jun. 5, 2020 in corresponding Korean Patent Application No. 10-2019-7017120, with Machine translation.

(Continued)

*Primary Examiner* — S. Joseph Morano
*Assistant Examiner* — Jovon E Hayes
(74) *Attorney, Agent, or Firm* — Wenderoth, Lind & Ponack, L.L.P.

(57) ABSTRACT

A maintenance facility includes: a first barge; a first connection portion disposed on the first barge and configured to connect the first barge to a second barge mounted with a device including a maintenance target portion; and a building disposed on the first barge and including a wall portion and a roof portion. On the first barge, a temporary placing space in which the maintenance target portion can be placed is disposed between the first connection portion and the building.

5 Claims, 5 Drawing Sheets

(56) References Cited

U.S. PATENT DOCUMENTS

| | | | | |
|---|---|---|---|---|
| 9,547,308 | B2 * | 1/2017 | Merchant | B63H 5/125 |
| 9,567,044 | B2 * | 2/2017 | Vandenworm | B63B 27/30 |
| 2010/0150693 | A1 * | 6/2010 | Frassinelli | F01D 25/28 414/800 |
| 2014/0261128 | A1 * | 9/2014 | McKillop | B63B 35/44 114/121 |
| 2014/0366792 | A1 * | 12/2014 | Steven | F03D 13/40 114/72 |
| 2019/0291829 | A1 * | 9/2019 | Yamazaki | B63B 27/10 |

FOREIGN PATENT DOCUMENTS

| | | | |
|---|---|---|---|
| JP | 59-115806 | | 8/1984 |
| JP | 60-040389 | | 3/1985 |
| JP | 1-71105 | | 5/1989 |
| JP | 2010-168217 | | 8/2010 |
| JP | 2010-175262 | | 8/2010 |
| JP | 2010175262 | A * | 8/2010 |
| JP | 5480991 | B1 * | 4/2014 ..... D06L 4/621 |
| KR | 20-2015-0003643 | | 10/2015 |
| WO | 2007/009464 | | 1/2007 |

OTHER PUBLICATIONS

Office Action dated Jul. 29, 2020 in corresponding Chinese Patent Application No. 201880005230.3, with English translation.

Written Opinion dated Mar. 13, 2020 in corresponding Singapore Application No. 11201904343W.

International Search Report dated Jun. 26, 2018 in International (PCT) Application No. PCT/JP2018/011542 with English translation.

International Preliminary Report on Patentability and Written Opinion of the International Searching Authority dated Oct. 10, 2019 in International (PCT) Application No. PCT/JP2018/011542 with English translation.

Office Action dated Jun. 29, 2021 in corresponding Japanese Patent Application No. 2017-072106 with English translation.

Office Action dated Mar. 2, 2021 in corresponding Japanese Patent Application No. 2017-072106 with English-language translation.

* cited by examiner

MAINTENANCE FACILITY, POWER GENERATION FACILITY, AND MAINTENANCE METHOD FOR DEVICE

TECHNICAL FIELD

This disclosure relates to a maintenance facility, a power generation facility, and a maintenance method for a device.

BACKGROUND ART

A plant in which various devices are installed on a barge is often used as a plant on water.

For instance, Patent Document 1 discloses a compact combined plant in which constitutional devices such as a gas turbine, a steam turbine, and a generator are installed on a barge. In this combined plant, a configuration for reducing a distance between devices is adopted in an exhaust gas discharge section of the gas turbine to reduce the size of the barge, and various devices such as cooler and a condenser are installed not only on a barge deck surface but also on a barge bottom surface to make use of the space.

CITATION LIST

Patent Literature

Patent Document 1: JPS59-115806U (Utility Model)

SUMMARY

Problems to be Solved

Maintenance such as inspection for devices installed on the barge is often desirably performed on the barge. This case is advantageous in that time for transferring the barge is saved, compared to a case where the barge is transferred to a dry dock or the like for maintenance. However, the barge installed with devices usually needs to move along sea or river, which restricts the size of the barge. Thus, it is difficult to ensure enough space on the barge for maintenance of devices to perform maintenance sufficiently on the barge.

In view of the above, an object of at least one embodiment of the present invention is to provide a maintenance facility, a power generation facility, and a maintenance method for a device, whereby it is possible to appropriately perform, on a barge, maintenance of a device installed on the barge.

Solution to the Problems (1) A maintenance facility according to at least one embodiment of the present invention comprises: a first barge; a first connection portion disposed on the first barge and configured to connect the first barge to a second barge mounted with a device including a maintenance target portion; and a building disposed on the first barge and including a wall portion and a roof portion, wherein, on the first barge, a temporary placing space in which the maintenance target portion can be placed is disposed between the first connection portion and the building.

With the above configuration (1), by connecting the first barge to the second barge mounted with the device including the maintenance target portion and moving the maintenance target portion from the second barge to the first barge, it is possible to appropriately perform maintenance of the maintenance target portion on the first barge.

Further, with the above configuration (1), since the second barge mounted with the device including the maintenance target portion is provided separately from the first barge for maintenance of the maintenance target portion, it is possible to perform appropriate maintenance of the maintenance target portion, without excessively increasing the widths of the barges.

Further, with the above configuration (1), since the temporary placing space is disposed between the first connection portion and the building, it is possible to transfer the maintenance target portion smoothly between the second barge and the building on the first barge. Further, with the above configuration (1), since the building including the wall portion and the roof portion is disposed on the first barge, by performing maintenance of the maintenance target portion inside the building, it is possible to reduce salt damage or the like to the maintenance target portion on sea.

(2) In some embodiments, in the above configuration (1), the maintenance facility further comprises a utility device for maintenance disposed on the first barge.

With the above configuration (2), using the utility device for maintenance, it is possible to appropriately perform maintenance of the maintenance target portion on the first barge.

(3) In some embodiments, in the above configuration (1) or (2), the maintenance facility further comprises a transportation device capable of transporting the maintenance target portion on the first barge.

With the above configuration (3), since the maintenance target portion can be transferred on the first barge with the transportation device, it is possible to perform maintenance of the maintenance target portion smoothly.

(4) According to at least one embodiment of the present invention, a power generation facility comprises: a second barge including a second connection portion configured to be connected to a first barge for maintenance; a power generation device disposed on the second barge; and a crane disposed, on the second barge, between the second connection portion and a maintenance target portion of the power generation device.

With the above configuration (4), since the crane is disposed between the second connection portion and the maintenance target portion of the power generation device, on the second barge mounted with the power generation device, when the second barge is connected to the first barge, the crane is situated in the vicinity of the center of gravity of a floating boy formed by the first barge and the second barge which are connected with each other. Thus, it is possible to move the maintenance target portion stably between the first barge and the second barge.

Further, with the above configuration (4), since the crane is disposed on the second barge mounted with the power generation device, the crane and the device on the second barge oscillate at substantially the same oscillation period. Thus, when the maintenance target portion is lifted or lowered, damage due to contact with a portion in the vicinity of the maintenance target portion hardly occurs.

Accordingly, with the above configuration (4), it is possible to appropriately perform maintenance of the maintenance target portion.

(5) A maintenance method according to at least one embodiment of the present invention comprises: a step of connecting a first barge for maintenance to a second barge on which a device including a maintenance target portion is disposed; a step of moving the maintenance target portion to a temporary placing space of the first barge by a crane disposed on the second barge; and a step of performing maintenance of the maintenance target portion on the first barge.

With the above method (5), by connecting the first barge to the second barge mounted with the device including the maintenance target portion and moving the maintenance target portion from the second barge to the first barge by the crane disposed on the second barge, it is possible to appropriately perform maintenance of the maintenance target portion on the first barge.

Further, with the above method (5), since the second barge mounted with the device including the maintenance target portion is provided separately from the first barge for maintenance of the maintenance target portion, it is possible to perform appropriate maintenance of the maintenance target portion, without excessively increasing the widths of the barges.

(6) In some embodiments, in the above method (5), while the first barge is connected to the second barge, the maintenance target portion is moved to the temporary placing space disposed, on the first barge, between the second barge and a building disposed on the first barge, the building including a wall portion and a roof portion.

With the above method (6), since the temporary placing space is disposed between the first connection portion and the building, it is possible to transfer the maintenance target portion smoothly between the second barge and the building on the first barge. Further, with the above method (6), since the building including the wall portion and the roof portion is disposed on the first barge, by performing maintenance of the maintenance target portion inside the building, it is possible to reduce salt damage or the like to the maintenance target portion on sea.

(7) In some embodiments, in the above method (5) or (6), while the first barge is connected to the second barge, the maintenance target portion is moved to the temporary placing space by the crane disposed, on the second barge, between the maintenance target portion and the first barge.

With the above method (7), since on the second barge mounted with the power generation device, the crane is disposed between the first barge and the maintenance target portion of the device, when the second barge is connected to the first barge, the crane is situated in the vicinity of the center of gravity of a floating boy formed by the first barge and the second barge which are connected with each other. Thus, it is possible to move the maintenance target portion stably between the first barge and the second barge.

Further, with the above method (7), since the crane is disposed on the second barge mounted with the device including the maintenance target portion, the crane and the device on the second barge oscillate at substantially the same oscillation period. Thus, when the maintenance target portion is lifted or lowered, damage due to contact with a portion in the vicinity of the maintenance target portion hardly occurs.

Accordingly, with the above method (7), it is possible to appropriately perform maintenance of the maintenance target portion.

(8) In some embodiments, in any one of the above methods (5) to (7), the step of performing maintenance includes performing the maintenance of the maintenance target portion by using a utility device on the first barge.

With the above method (8), using the utility device for maintenance, it is possible to appropriately perform maintenance of the maintenance target portion on the first barge.

(9) In some embodiments, in any one of the above methods (5) to (8), the method further comprises a step of transporting the maintenance target portion placed in the temporary placing space to a building disposed on the first barge by a transportation device, and the step of performing maintenance includes performing the maintenance of the maintenance target portion inside the building.

With the above method (9), since the maintenance target portion can be transferred on the first barge with the transportation device, it is possible to perform maintenance of the maintenance target portion smoothly.

Advantageous Effects

According to at least one embodiment of the present invention, there is provided a maintenance facility, a power generation facility, and a maintenance method for a device, whereby it is possible to appropriately perform, on a barge, maintenance of a device installed on the barge.

DETAILED DESCRIPTION

Embodiments of the present invention will now be described in detail with reference to the accompanying drawings. It is intended, however, that unless particularly identified, dimensions, materials, shapes, relative positions and the like of components described in the embodiments shall be interpreted as illustrative only and not intended to limit the scope of the present invention.

First, a maintenance facility according to some embodiments and a power generation facility according to some embodiments will be described.

Figure 1:
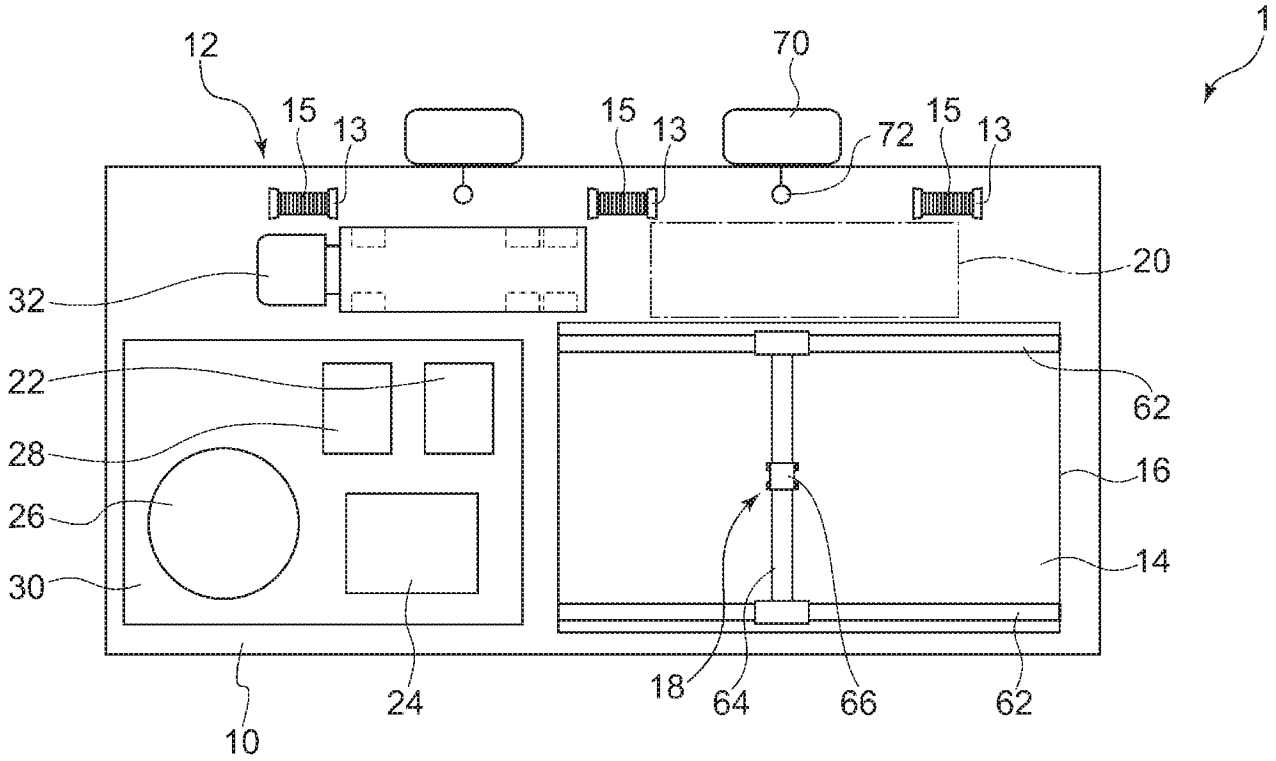
FIG. 1 is a schematic plan view of a maintenance facility according to an embodiment.
Figure 2:
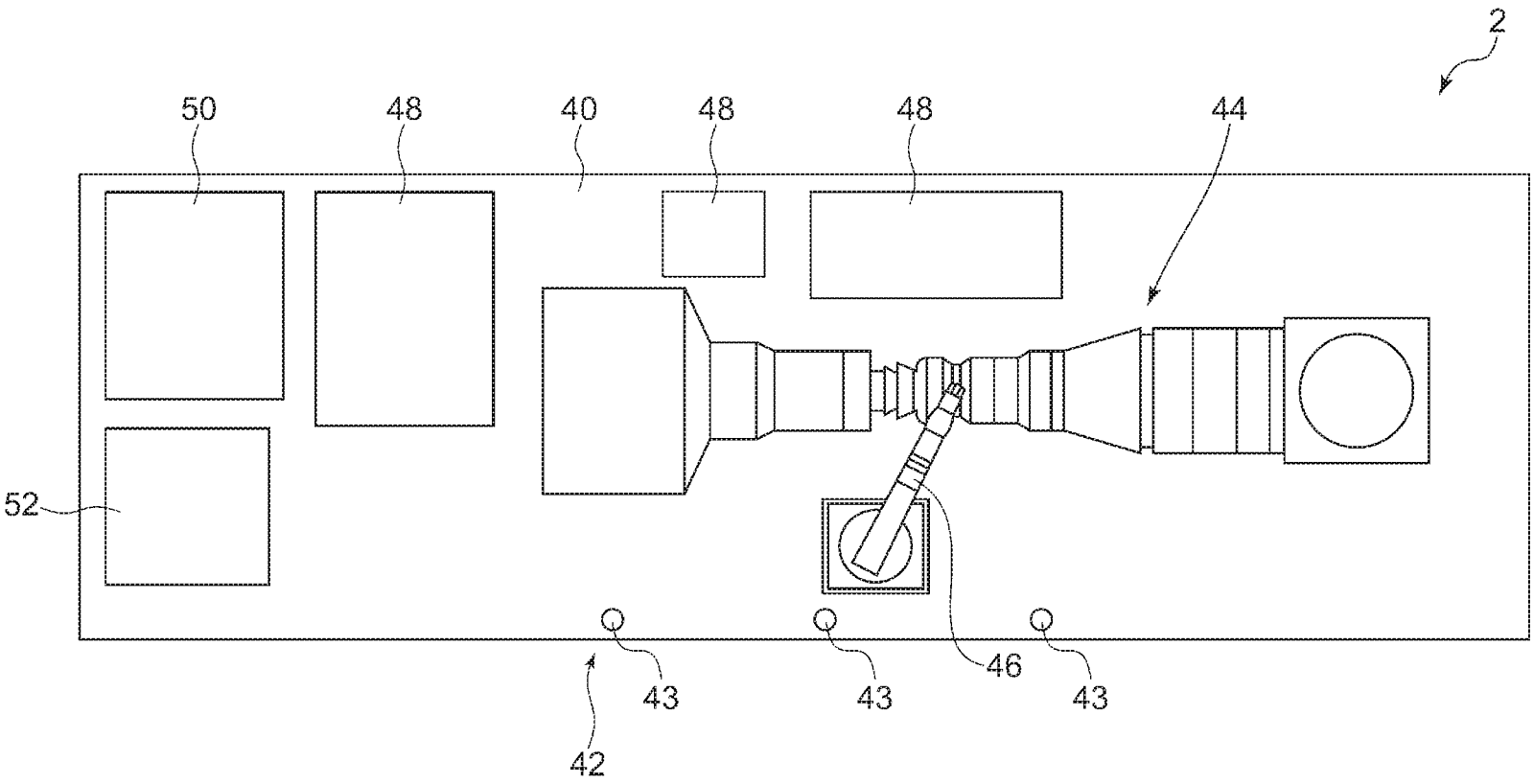
FIG. 2 is a schematic plan view of a power generation facility according to an embodiment.
Figure 3:
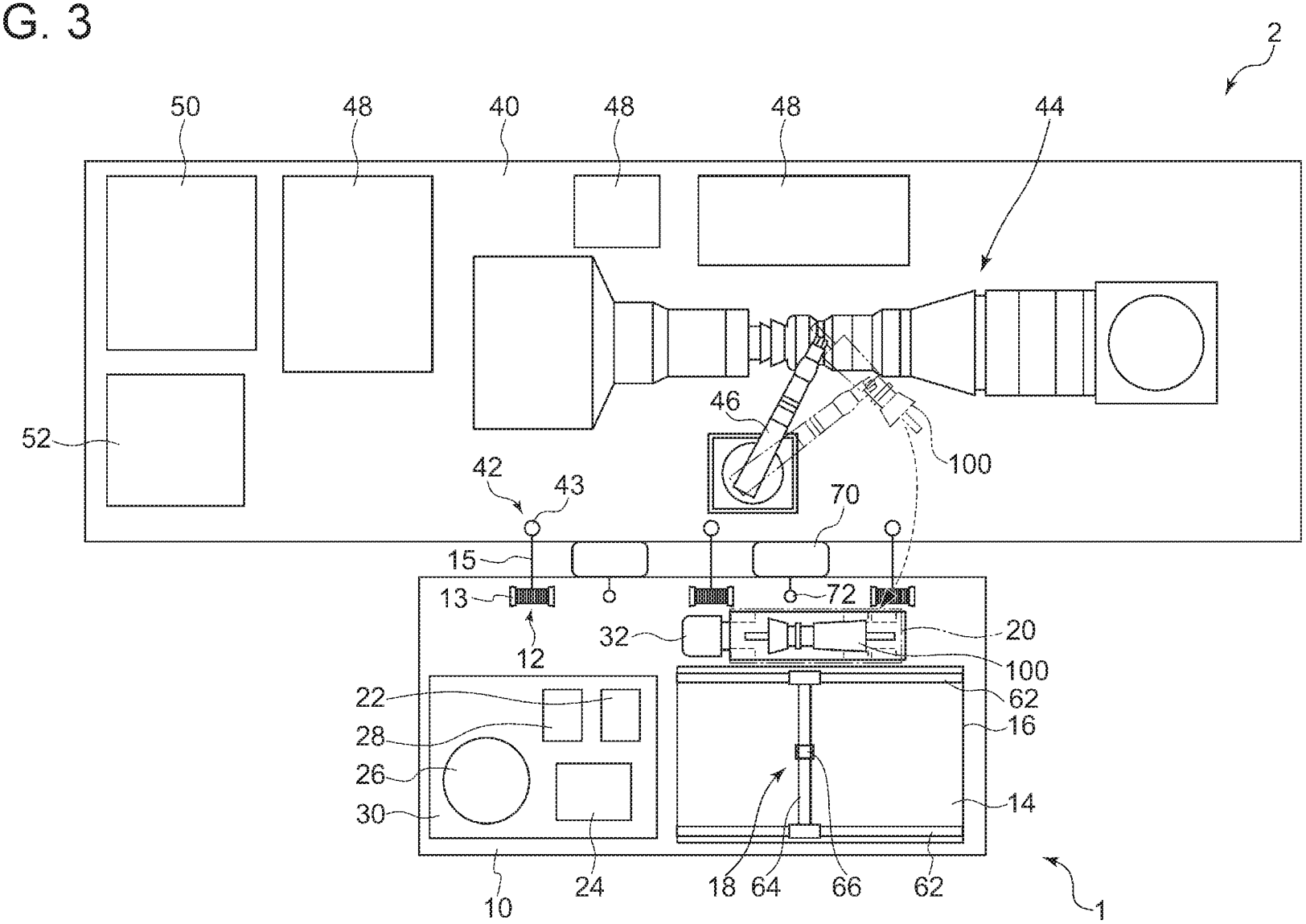
FIG. 3 is a diagram of a maintenance facility and a power generation facility which are connected to each other according to an embodiment.
Figure 4:
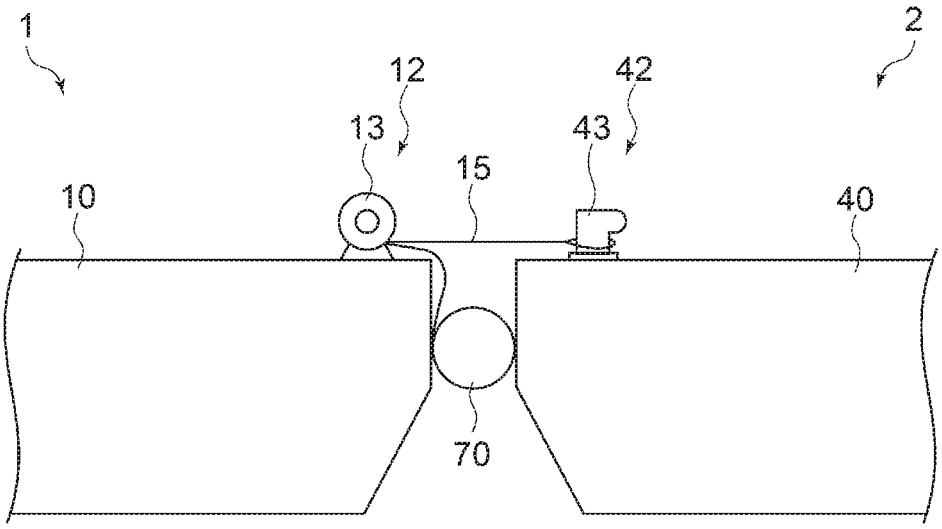
FIG. 4 is a schematic side view of the maintenance facility and the power generation facility shown in FIG. 3.

FIG. 1 is a schematic plan view of a maintenance facility according to an embodiment. FIG. 2 is a schematic plan view of a power generation facility according to an embodiment. FIG. 3 is a diagram of a maintenance facility and a power generation facility which are connected to each other according to an embodiment. FIG. 4 is a schematic side view of the maintenance facility and the power generation facility shown in FIG. 3. In FIGS. 3 and 4, the same features as in FIG. 1 or 2 are denoted by the same reference signs corresponding to those in FIG. 1 or 2.

The maintenance facility according to some embodiments is a facility for maintenance of a device of a facility (e.g., power generation facility) on water.

As shown in FIG. 1, the maintenance facility 1 according to an embodiment includes a first barge 10, which is a barge for maintenance, configured to float on water such as sea, lake, or river, a first connection portion 12 disposed on the first barge 10, and a building 14 disposed on the first barge 10. On the first barge 10, a temporary placing space 20 is disposed between the first connection portion 12 and the building 14.

The first barge 10 may be a typical barge not equipped with a power unit such as an engine. In this case, the barge may travel on water by propulsion force imparted from other vessels such as a tugboat or a pusher. Alternatively, the first barge 10 may be a self-propelled barge equipped with a power unit such as an engine.

The first connection portion 12 serves to connect the first barge 10 to a second barge mounted with a device including a maintenance target portion.

The second barge connected with the first barge 10 may be a barge (second barge 40) of a power generation facility 2 described later. The maintenance target portion may be a component of a power generation device mounted on the power generation facility.

Connection between the first barge 10 and the second barge via the first connection portion 12 will be described later.

The building 14 may be used to temporarily place therein the maintenance target portion moved from the second barge to the first barge 10 or to undergo maintenance (e.g. inspection or exchange of components) of the maintenance target portion therein.

The building 14 includes a wall portion 16 forming an interior space of the building 14 and a roof portion (not shown) covering the interior space surrounded by the wall portion 16. The building 14 may have a size capable of accommodating at least the maintenance target portion. Alternatively, the building 14 may have a size capable of accommodating a component of the maintenance target portion after the maintenance target portion is disassembled.

A device for maintenance of the maintenance target portion may be disposed inside the building 14. For instance, a crane 18 capable of lifting the maintenance target portion or a component of the maintenance target portion may be disposed inside the building 14.

As shown in FIG. 1, the crane 18 may be, for instance, an overhead crane disposed on a trolley 66 movable on a girder 64 supported by a pair of beams 62 disposed at an upper portion of the interior space of the building 14. The girder 64 may be movable along the extension direction of the beams 62.

The temporary placing space 20 is a space in which the maintenance target portion moved from the second barge to the first barge 10 is temporarily placed. The temporary placing space 20 is disposed between the first connection portion 12 and the building 14.

A utility device for maintenance of the maintenance target portion may be disposed on the first barge 10. The utility device may include, for instance, an air compressor 22, a generator 24, a water tank 26, or a pump 28.

The utility device may be disposed in a storage building 30 provided separately from the building 14, as shown in FIG. 1. Alternatively, the utility device may be disposed in the building 14 described above.

A transportation device 32 capable of transporting the maintenance target portion may be disposed on the first barge 10. The transportation device 32 may be, for instance, a transportation vehicle such as a trailer or a forklift. The transportation device 32 shown in FIG. 1 is a trailer.

The first barge 10 may be provided with a fender 70 for preventing contact between the first barge 10 and the second barge connected to the first barge 10. The fender 70 may be disposed on a side surface on which the first connection portion 12 is disposed, or may be fastened to a fender fixation tool 72 disposed on the first barge 10 via a rope. The fender 70 may be made of rubber, for instance.

The power generation facility according to some embodiments is a facility for generating electric power on water and is configured to enable maintenance (e.g. inspection or exchange of components) of a power generation device of the power generation facility on the barge for maintenance.

As shown in FIG. 2, the power generation facility 2 according to an embodiment includes a second barge 40 configured to float on water such as sea, lake, or river, a power generation device 44 disposed on the second barge 40, and a crane 46 disposed on the second barge 40.

The second barge 40 may be a typical barge not equipped with a power unit such as an engine. In this case, the barge may travel on water by propulsion force imparted from other vessels such as a tugboat or a pusher. Alternatively, the second barge 40 may be a self-propelled barge equipped with a power unit such as an engine.

The second barge 40 is provided with a second connection portion 42 for connecting a first barge for maintenance (e.g. first barge 10 of the maintenance facility 1 described above).

The second connection portion 42 disposed on the second barge 40 and the first connection portion 12 disposed on the first barge 10 of the maintenance facility 1 described above are configured to be connected with each other. The connection form between the first connection portion 12 and the second connection portion 42 are not limited to a particular form; a general method for connecting barges can be adopted.

In some embodiments, the first connection portion 12 (see FIG. 1) of the first barge 10 includes a mooring rope 15 for connecting the first barge 10 and the second barge 40, and a winch 13 for winding the mooring rope 15. A first end of the mooring rope 15 is fixed to the winch 13. The second connection portion 42 (see FIG. 2) of the second barge 40 includes a rope fixation tool 43 for fixing a second end of the mooring rope 15 to the second barge 40. Further, as shown in FIGS. 3 and 4, by connecting the second end of the mooring rope 15 to the rope fixation tool 43, the first barge 10 and the second barge 40 are connected.

In FIG. 4, devices and facilities disposed on the first barge 10 and the second barge 40 other than the first connection portion 12 and the second connection portion 42 are not depicted for clarity.

The power generation device 44 may be, for instance, a power generation device including a turbine such as a gas turbine or a steam turbine and a generator. In the exemplary embodiments shown in FIG. 2, the power generation device 44 is a gas turbine power generation device including a gas turbine and a generator.

On the second barge 40, an auxiliary 48 necessary for operating the power generation device 44, a control device 50 for controlling the power generation device 44 or the auxiliary 48, or a device, such as a transformer 52, necessary for the power generation facility 2 to function may be disposed.

The crane 46 is disposed on the second barge 40 between the power generation device 44 and the second connection portion 42.

The crane 46 may be lateral to the turbine (gas turbine or steam turbine) of the power generation device 44 in the axial direction.

In some embodiments, the maintenance target portion of the power generation device may be a turbine rotor of a gas turbine or a steam turbine.

Next, a method for performing maintenance of the maintenance target portion of the power generation device 44 of the power generation facility 2 (see FIG. 2) using the maintenance facility 1 (see FIG. 1) will be described.

In the following, explanation will be given in conjunction with a case where the maintenance target portion is a rotor 100 (see FIG. 3) of the gas turbine power generation device.

However, the maintenance target portion in the present invention is not limited to the rotor 100 of the gas turbine.

Figure 5:
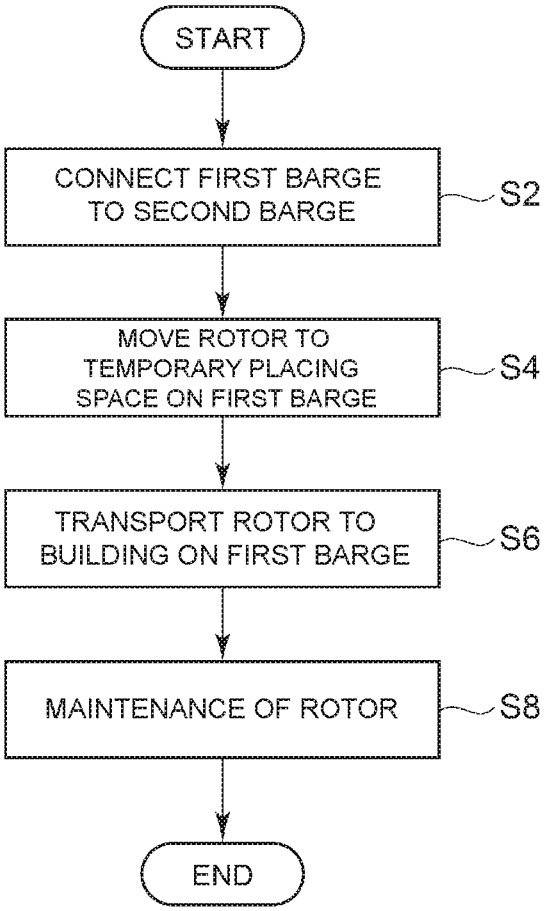
FIG. 5 is a flowchart of a maintenance method according to an embodiment.

FIG. 5 is a flowchart of a maintenance method according to an embodiment.

The maintenance method according to some embodiments includes, as shown in FIG. 5, a connection step S2, a movement step S4, and a maintenance step S8. In some embodiments, after the movement step S4 and before the maintenance step S8, a transportation step S6 may be performed.

Each step will now be described in detail.

(Connection Step)

In the connection step S2, the first barge 10 (see FIG. 1) of the maintenance facility 1 is connected to the second barge 40 (see FIG. 2) of the power generation facility 2 provided with the gas turbine power generation device (power generation device 44) including the rotor 100 which is the maintenance target portion.

In some embodiments, as shown in FIGS. 3 and 4, the first barge 10 and the second barge 40 may be connected via the first connection portion 12 of the first barge 10 and the second connection portion 42 of the second barge 40.

For instance, the first barge 10 may be connected to the second barge 40 by connecting the second end of the mooring rope 15 (first connection portion 12), which has the first end fixed to the winch 13 (first connection portion 12) on the first barge 10, to the rope fixation tool 43 (second connection portion 42) on the second barge 40.

In an embodiment, after the second end of the mooring rope 15 is connected to the rope fixation tool 43 on the second barge 40, the mooring rope 15 may be wound by the winch 13 (i.e., tension may be imparted to the mooring rope 15) with the fender 70 being interposed between the first barge 10 and the second barge 40. Thereby, it is possible to connect the first barge 10 and the second barge 40 stably while connection between the first barge 10 and the second barge 40 is prevented.

(Movement Step)

In the movement step S4, the crane 46 disposed on the second barge 40 moves the rotor 100, which is the maintenance target portion, to the temporary placing space 20 of the first barge 10.

In the movement step S4 according to an embodiment, after a casing accommodating the rotor 100 of the power generation device (gas turbine power generation device) 44 is detached, the rotor 100 is lifted by the crane 46. Then, as shown in FIG. 3, while the second barge 40 is connected with the first barge 10, the crane 46 is rotated so that the lifted rotor 100 is moved to a position above the temporary placing space 20 of the first barge 10. In this position, the crane 46 lowers the rotor 100 and places the rotor 100 in the temporary placing space 20.

In FIG. 3, a state where the crane 46 is rotated to move the rotor 100 is shown by the long-dashed double-dotted line; and the rotor 100 placed in the temporary placing space 20 of the first barge 10 is shown by the solid line. Further, FIG. 3 show a state where the casing is not detached from the power generation device 44 for clarity of the figure.

(Transportation Step)

In the transportation step S6, the rotor 100, which is the maintenance target portion, disposed in the temporary placing space 20 is transported to the building 14 disposed on the first barge 10 by the transportation device 32.

In an embodiment, before the rotor 100 as the maintenance target portion is moved by the crane 46 in the movement step S4, a bed section of the transportation device 32 may be disposed in the temporary placing space 20 in advance, and at a time when the rotor 100 is placed in the temporary placing space 20, the rotor 100 may be placed on the bed section of the transportation device 32 disposed in the temporary placing space 20. Then, the transportation device 32 may be moved from the temporary placing space 20 to the building 14 to transport the rotor 100 to the building 14.

The transportation step S6 is an optional step performed as needed. In some embodiments, the transportation step S6 may be not performed.

(Maintenance Step)

In the maintenance step S8, maintenance operation (e.g. inspection or exchange of components) of the rotor 100 which is the maintenance target portion is performed on the first barge 10.

The maintenance step S8 may be performed inside the building 14 on the first barge 10.

Further, in the maintenance step S8, maintenance of the rotor 100 may be performed by using the utility device (e.g. air compressor 22, generator 24, water tank 26, or pump 28 described above) on the first barge.

According to the maintenance facility 1 and the power generation facility 2, or the maintenance method described above, the first barge 10 is connected to the second barge 40 mounted with the power generation device 44 including the rotor 100 which is the maintenance target portion, and the rotor 100 is moved from the second barge 40 to the first barge 10 by the crane 46 disposed on the second barge 40. Thereby, it is possible to appropriately perform maintenance of the rotor 100 on the first barge 10.

Further, since the second barge 40 mounted with the power generation device 44 including the rotor 100 as the maintenance target portion is provided separately from the first barge 10 for maintenance of the rotor 100, it is possible to perform appropriate maintenance of the rotor 100 of the maintenance target portion, without excessively increasing the widths of the barges (first barge 10 and second barge 40).

Further, since the temporary placing space 20 is disposed between the first barge 10 and the building 14, it is possible to transfer the rotor 100 as the maintenance target portion smoothly between the second barge 40 and the building 14 on the first barge 10. Further, since the building 14 including the wall portion 16 and the roof portion is disposed on the first barge 10, by performing maintenance of the rotor 100 as the maintenance target portion inside the building 14, it is possible to reduce salt damage or the like to the rotor 100 on sea.

Further, since the crane 46 is disposed between the first barge 10 and the rotor 100, which is the maintenance target portion of the power generation device 44, on the second barge 40 mounted with the power generation device 44, when the second barge 40 is connected to the first barge 10, the crane 46 is situated in the vicinity of the center of gravity of a floating boy formed by the first barge 10 and the second barge 40 which are connected with each other. Thus, it is possible to move the rotor 100 as the maintenance target portion stably between the first barge 10 and the second barge 40.

Further, since the crane 46 is disposed on the second barge 40 mounted with the power generation device 44 including the rotor 100 as the maintenance target portion, the crane 46 and the power generation device 44 on the second barge 40 oscillate at substantially the same oscillation period. Thus, when the rotor 100 as the maintenance target portion is lifted or lowered, damage due to contact with a portion (e.g., casing) in the vicinity of the rotor 100 hardly occurs.

Further, use of the utility device on the first barge 10 enables appropriate maintenance of the rotor 100 as the maintenance target portion.

Moreover, by transferring the rotor 100 as the maintenance target portion on the first barge 10 with the transportation device 32, it is possible to perform maintenance of the maintenance target portion smoothly.

Embodiments of the present invention were described in detail above, but the present invention is not limited thereto, and various amendments and modifications may be implemented.

Further, in the present specification, an expression of relative or absolute arrangement such as "in a direction", "along a direction", "parallel", "orthogonal", "centered", "concentric" and "coaxial" shall not be construed as indicating only the arrangement in a strict literal sense, but also includes a state where the arrangement is relatively displaced by a tolerance, or by an angle or a distance whereby it is possible to achieve the same function.

For instance, an expression of an equal state such as "same" "equal" and "uniform" shall not be construed as indicating only the state in which the feature is strictly equal, but also includes a state in which there is a tolerance or a difference that can still achieve the same function.

Further, for instance, an expression of a shape such as a rectangular shape or a cylindrical shape shall not be construed as only the geometrically strict shape, but also includes a shape with unevenness or chamfered corners within the range in which the same effect can be achieved.

On the other hand, an expression such as "comprise", "include" and "have" are not intended to be exclusive of other components.

REFERENCE SIGNS LIST

1 Maintenance facility
2 Power generation facility
10 First barge
12 First connection portion
13 Winch
14 Building
15 Mooring rope
16 Wall portion
18 Crane
20 Temporary placing space
22 Air compressor
24 Generator
26 Water tank
28 Pump
30 Storage building
32 Transportation device
40 Second barge
42 Second connection portion
43 Rope fixation tool
44 Power generation device
46 Crane
48 Auxiliary
50 Control device
52 Transformer
62 Beam
64 Girder
66 Trolley
70 Fender
72 Fender fixation tool
100 Rotor

The invention claimed is:

1. A maintenance facility comprising:

a first barge;

a first connection portion disposed on the first barge and configured to connect the first barge to a second barge mounted with a device including a maintenance target portion;

a building disposed on the first barge and including a wall portion and a roof portion, the building being capable of accommodating the maintenance target portion; and a crane disposed inside the building, the crane being capable of lifting the maintenance target portion, wherein, on the first barge, a temporary placing space in which the maintenance target portion can be placed is disposed between the first connection portion and the building.

2. The maintenance facility according to claim 1, further comprising a utility device for maintenance disposed on the first barge.

3. The maintenance facility according to claim 1, further comprising a transportation device capable of transporting the maintenance target portion on the first barge.

4. A power generation facility comprising:

a second barge including a second connection portion configured to be connected to a first barge for maintenance;

a power generation device disposed on the second barge; and a crane disposed, on the second barge, between the second connection portion and a maintenance target portion of the power generation device, wherein the crane is disposed on a lateral side of a turbine of the power generation facility in an axial direction of the turbine.

5. The power generation facility according to claim 4, wherein the crane is disposed so as to overlap with the power generation device in an axial direction of the turbine.

* * * * *